US006913448B2

(12) United States Patent
Liang et al.

(10) Patent No.: US 6,913,448 B2
(45) Date of Patent: Jul. 5, 2005

(54) LOAD-REGULATING DEVICE FOR SCROLL TYPE COMPRESSORS

(75) Inventors: Kun-I Liang, Judung Hsinchu (TW); Yu-Choung Chang, Judung Hsinchu (TW); Ching-Feng Lai, Judung Hsinchu (TW); Ann- Huang, Judung Hsinchu (TW)

(73) Assignee: Industrial Technology Research Institute (TW)

( * ) Notice: Subject to any disclaimer, the term of this patent is extended or adjusted under 35 U.S.C. 154(b) by 57 days.

(21) Appl. No.: 10/330,055

(22) Filed: Dec. 30, 2002

(65) Prior Publication Data

US 2004/0126246 A1 Jul. 1, 2004

(51) Int. Cl.[7] ..... F04B 17/03

(52) U.S. Cl. ..... 417/410.5; 417/310; 418/53.4; 418/55.5

(58) Field of Search ..... 417/410.5, 310; 418/53.4, 55.5

(56) References Cited

U.S. PATENT DOCUMENTS

| | | | | | |
|---|---|---|---|---|---|
| 4,840,545 | A | * | 6/1989 | Moilanen | 417/301 |
| 5,141,420 | A | | 8/1992 | Nambiar | 418/55.1 |
| 5,156,539 | A | | 10/1992 | Anderson et al. | 418/55.4 |
| RE35,216 | E | | 4/1996 | Anderson et al. | 417/310 |
| 5,613,841 | A | * | 3/1997 | Bass et al. | 417/310 |
| 6,048,184 | A | * | 4/2000 | Chang et al. | 418/55.5 |
| 6,059,549 | A | | 5/2000 | Tarng et al. | 418/55.4 |
| 6,293,767 | B1 | * | 9/2001 | Bass | 417/310 |
| 6,390,792 | B1 | | 5/2002 | Tarng et al. | 418/55.1 |
| 6,454,538 | B1 | * | 9/2002 | Witham et al. | 417/32 |
| 6,709,244 | B2 | * | 3/2004 | Pham | 417/292 |
| 2001/0002239 | A1 | * | 5/2001 | Pham et al. | 417/299 |
| 2001/0028852 | A1 | * | 10/2001 | Yuzaki et al. | 417/310 |
| 2002/0159898 | A1 | * | 10/2002 | Rajendran et al. | 417/410.5 |

* cited by examiner

*Primary Examiner*—Cheryl Tyler
*Assistant Examiner*—Emmanuel Sayoc
(74) *Attorney, Agent, or Firm*—Arent Fox PLLC

(57) ABSTRACT

A load-regulating device for scroll type compressors comprising a compressor housing, a bracket body, a partition block, a gliding block, a pair of scrolls and a plurality of air chambers, wherein the gliding block being coupled with the pair of scrolls for defining a plurality of air chambers on the scrolls, the pressure variation in the air chambers is then utilized for causing the motion of the gliding block, enabling the compressor to cause the gliding block by means of the pressure variation to motion upwardly as the compressor is actuated, and preventing the fluid in the high-pressure chamber from leaking towards the low-pressure chamber, thus allowing the compressors to quickly build up the pressure; the gliding block is caused by the pressure variation to motion downwardly at times when the compression ratio is excessively high, so as to relieve part of the load, thus improving the performance and reliability of the compressors.

13 Claims, 4 Drawing Sheets

LOAD-REGULATING DEVICE FOR SCROLL TYPE COMPRESSORS

BACKGROUND OF THE INVENTION

1. Field of the Invention

The present invention refers to a load-regulating device for scroll type compressors, particularly the rendering of a gliding block coupled with a pair of scrolls for defining a plurality of air chambers on the scrolls, so as to cause the motion of the gliding block by means of the pressure variation in the air chambers.

2. Description of Related Art

The design for general compressors must provide the functions of preventing fluid from flowing backwards and building up pressure quickly as the compressors are actuated, and the excessively high pressure should be prevented from being accumulated so that the scrolls will not be damaged.

A prior art as revealed in U.S. Pat. No. 6,059,549 shows an improved high-low-pressure sealing structure of scroll type compressors, whereby a gliding block is coupled with scrolls to form a single air chamber on the scrolls. As the compressor is actuated, the gliding block is caused to motion upwardly by means of the pressure variation in the air chamber coupling with the spring element to support the partition block for preventing the fluid in the high-pressure chamber from leaking towards the low-pressure chamber in order for the compressor to quickly build up pressure. However, the drawback of such a framework is that the amount of force present for the gliding block to solely motion upwardly is almost close to zero at time of actuation of the compressor or at times when the compression ratio is too low, thus making the gliding block unable to overcome the friction and weight and motion upwardly, resulting in leakage and failure of building up pressure. Therefore, requiring additional force of the spring element to cause the gliding block to motion upwardly; at times when the compression ratio is excessively high, with the force imposed on the gliding block plus the upwardly-thrusting force of the spring element, the gliding block is forced not to be able to motion downwardly to relieve part of the load, thus affecting the reliability of the compressor.

The present invention is to provide a load-regulating device for scroll type compressors that, by rendering a gliding block coupled with a pair of scrolls for defining a plurality of air chambers on the scrolls, the motion of the gliding block is caused by means of the pressure variation in the air chambers.

SUMMARY OF THE INVENTION

The primary object of the present invention is to provide a load-regulating device for scroll type compressors, wherein the pressure variation in the air chambers is utilized for causing the motion of the gliding block, thus enabling the compressor to cause the gliding block by means of the pressure variation to motion upwardly at the actuation of the compressor, and preventing the fluid in the high-pressure chamber from leaking towards the low-pressure chamber, consequently allowing the compressor to quickly build up pressure, and then the gliding block is caused by the pressure variation to motion downwardly at times when the compression ratio is excessively high, so as to relieve a portion of the load.

The load-regulating device for scroll type compressors capable of achieving the object aforesaid comprises a compressor housing having an inlet and an outlet; a bracket body, being fixed inside the compressor housing and defining with the compressor housing a chamber; a partition block, being fixed inside the compressor housing and located on top of the bracket body to divide the chamber into a high-pressure chamber and a low-pressure chamber defined with the bracket body and the partition block, which has a letting-out hole at the center thereof; a pair of scrolls, consisting of a fixed scroll and a rotary scroll convoluting each other and being installed between the partition block and the bracket body; a gliding block, being installed on the center portion of the top of the fixed scroll; a plurality of air chambers, being defined with the gliding block coupled with the pair of scrolls, by means of the coupling of the gliding block and the pair of scrolls, defining a plural number of air chambers on the scrolls, then causing the motion of the gliding block by means of the pressure variation in the plurality of air chambers.

Preferably, the partition block is further installed with at least a back-pressure regulating ring.

Preferably, the top of the scroll blades of both fixed scroll and the rotary scroll can further be respectively installed with a sealing component.

The present invention is hereby presented for providing a load-regulating device for scroll type compressors applying the coupling of a gliding block and scrolls, wherein the gliding block is coupled with the pair of scrolls for defining a plurality of air chambers on the scrolls, the pressure variation in the air chambers is then utilized to cause the motion of the gliding block, thus enabling the compressor to cause the gliding block by means of the pressure variation to motion upwardly as the compressor is actuated, and preventing the fluid in the high-pressure chamber from leaking towards the low-pressure chamber, thus allowing the compressors to quickly build up pressure; the gliding block is caused by the pressure variation to motion downwardly at times when the compression ratio is excessively high to relieve a portion of the load, so as to improve the performance and reliability of the compressors, and eliminate the deficiency of the prior art in effective manner.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENT

The following is a detailed description of the best presently known modes of carrying out the inventions. This description is not to be taken in a limiting sense, but is made merely for the purpose of illustrating the general principles of the inventions.

Figure 1:
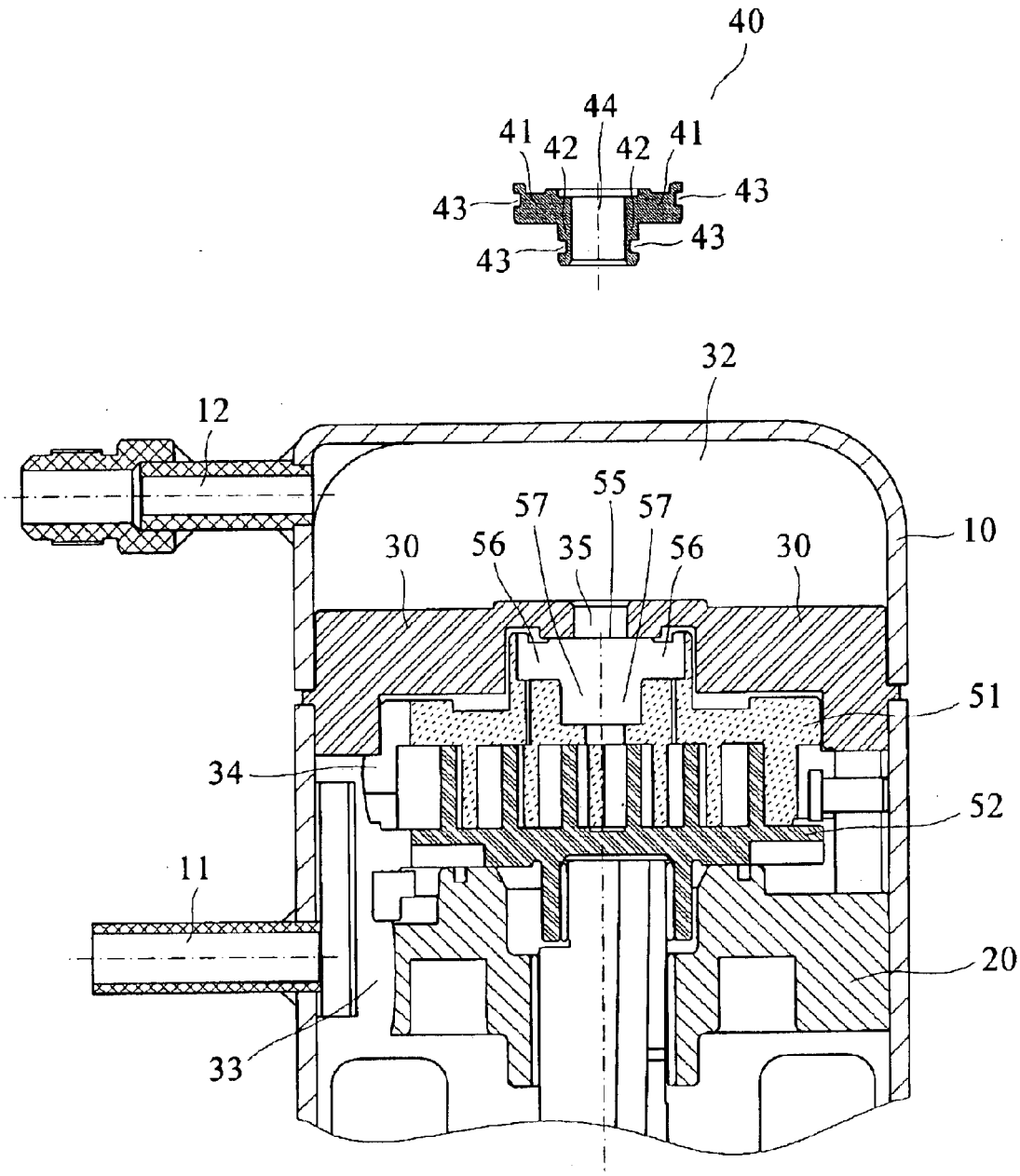
FIG. 1 illustrates the vertically sectional, dissected and structural view of the load-regulating device for scroll type compressors of the present invention.

Please refer to FIG. 1, which shows the vertically sectional, dissected and structural view of the load-regulating device for scroll type compressors of the present invention, the device of the present invention comprises a compressor housing 10, a bracket body 20, a partition block 30, a gliding block 40, a pair of scrolls and a plurality of air chambers, wherein the compressor housing 10 containing an air supply inlet 11 and an air exhaust outlet 12; the bracket body 20 being fixed inside the compressor housing 10 and defining with the compressor housing 10 a chamber; the partition block 30, being fixed inside the compressor housing 10 and located on top of the bracket body 20 to divide the chamber into a high-pressure chamber 32 and a low-pressure chamber 33 defined with the bracket body 20 and the partition block 30, which has a letting-out hole 35 at the center thereof; the pair of scrolls, consisting of a fixed scroll 51 and a rotary scroll 52 convoluting each other and being installed between the partition block 30 and the bracket body 20; the gliding block, being installed at the center portion of the fixed scroll 51; the plurality of air chambers, being defined with the gliding block 40 coupled with the pair of scrolls.

Figure 2:
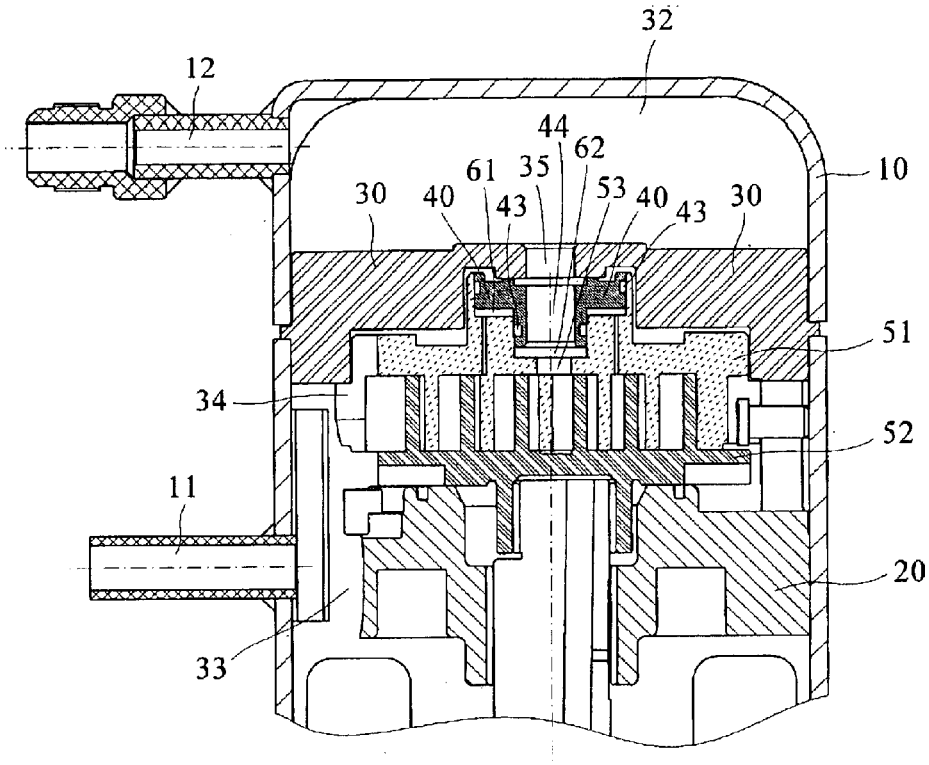
FIG. 2 illustrates the vertically sectional, combined and structural view of the load-regulating device for scroll type compressors of the present invention.

Please continue refer to FIG. 1 in accordance with FIG. 2, which shows the vertically sectional, combined and structural view of the load-regulating device for scroll type compressors of the present invention. Preferably, a round-shaped receiving chamber 55 is mounted on top of the fixed scroll 51 for receiving the round-shaped gliding block 40. The receiving chamber 55 includes a first chamber 56 and a second chamber 57, and the first chamber 56 is mounted on top of the second chamber 57, with the diameter of the first chamber 56 longer than that of the second chamber 57. The gliding block 40 includes a first portion 41 and a second portion 42, and the first portion 41 is mounted on top of the second portion 42, with the diameter of the first portion 41 longer than that of the second portion 42. Therefore, as the gliding block is received in the receiving chamber 55, the first portion 41 of the gliding block 40 is located inside the first chamber 56, and the second portion 42 of the gliding block 40 is located inside the second chamber 57. Consequently, an air chamber 61 is formed between the first portion 41 of the gliding block 40 and the first chamber 56 of the receiving chamber 55, and an air chamber 62 is formed between the second portion 42 of the gliding block 40 and the second chamber 57 of the receiving chamber 55. The first chamber 56 and the second chamber 57 of the receiving chamber 55 are integrally formed, whereas the first portion 41 and the second portion 42 of the gliding block 40 are also integrally formed. Air-proof members 43 such as O-shaped rings or Teflon lip seals are respectively mounted on walls of the first portion 41 and the second portion 42 so as to prevent gas between the gliding block 40 and the receiving chamber 55 from leaking.

Preferably, an air hole 44 is mounted at the center of the gliding block 40 to communicate with an air outlet 35 of the gliding block 40 and the letting-out hole 53 of the fixed scroll 51.

Figure 3:
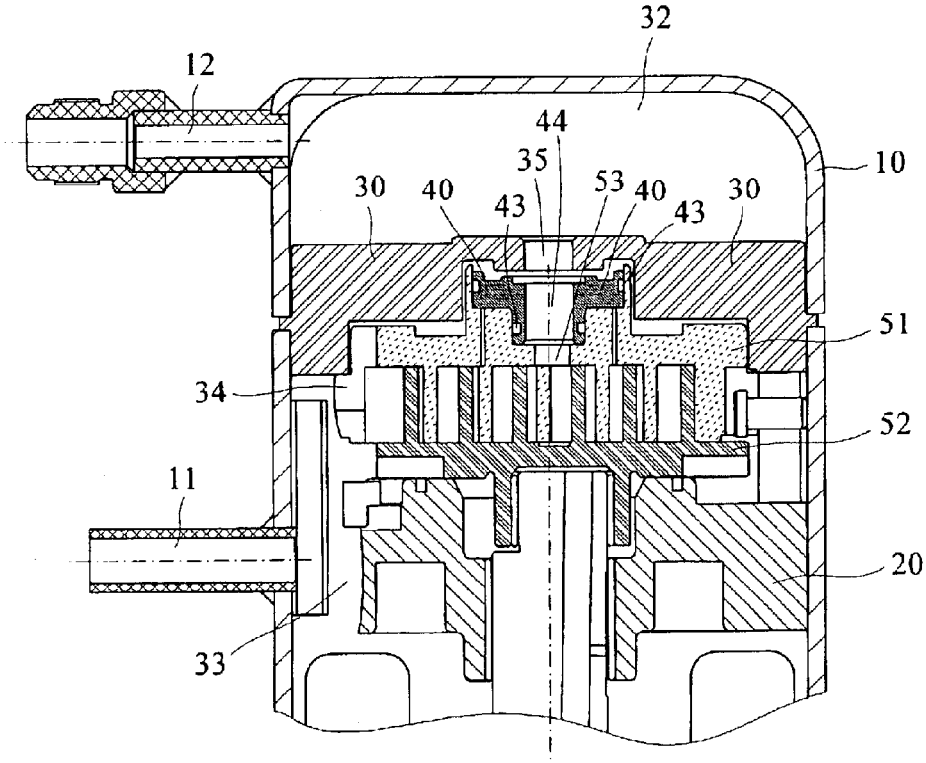
FIG. 3 illustrates the vertically sectional, motional and structural view of the load-regulating device for scroll type compressors of the present invention.

Please continue refer to FIG. 2 in accordance with FIG. 3, which shows the vertically sectional, motional and structural view of the load-regulating device for scroll type compressors of the present invention, wherein the air supply inlet 11 of the compressor housing 10 is utilized for introducing the working fluid to the interior of the compressor for the processing of air compression, whereas the air exhaust outlet 12 of the housing 10 is for letting out the pressurized air generated from the air compression through the air exhaust outlet 12 of the housing 10; the fixed scroll 51 and the rotary scroll 52 being installed with spiral blades and the gliding block 40 containing a letting-out hole 53 at its center, the letting-out hole 53 being an outlet for the working fluid after being compressed from the state of low pressure to the state of high pressure to flow therethrough; the plurality of air chambers of air chamber 61 and air chamber 62 being defined between the gliding block 40 and the pair of scrolls.

As the compressor is actuated, the low pressure fluid is introduced through the air supply inlet 12 of the housing 10 into the low-pressure chamber 33 of the compressor, through a sucking-in hole 34 into the pair of scrolls, by means of the co-orbiting motion of the fixed scroll 51 and the rotary scroll 52, filling the air chamber 61 with air rapidly, at this moment the upwardly-thrusting force imposed by the air chamber 61 on the gliding block 40 being larger than the downwardly-thrusting force imposed by the air chamber 62 on the gliding block 40, enabling the gliding block 40 to motion upwardly (Please refer to FIG. 2), and thus allowing the compressor to build up pressure; at time when the compression ratio is excessively high, the pressure in the air chamber 62 being a lot higher than that in the air chamber 61, which causes the gliding block 40 to motion downwardly, plus the weight of the gliding block 40, the two forces then jointly causing the gliding block 40 to motion downwardly (Please refer to FIG. 3), and thus allowing the fluid in the high-pressure chamber 32 to leak to the low-pressure chamber 33 so as to relieve part of the load.

Figure 4:
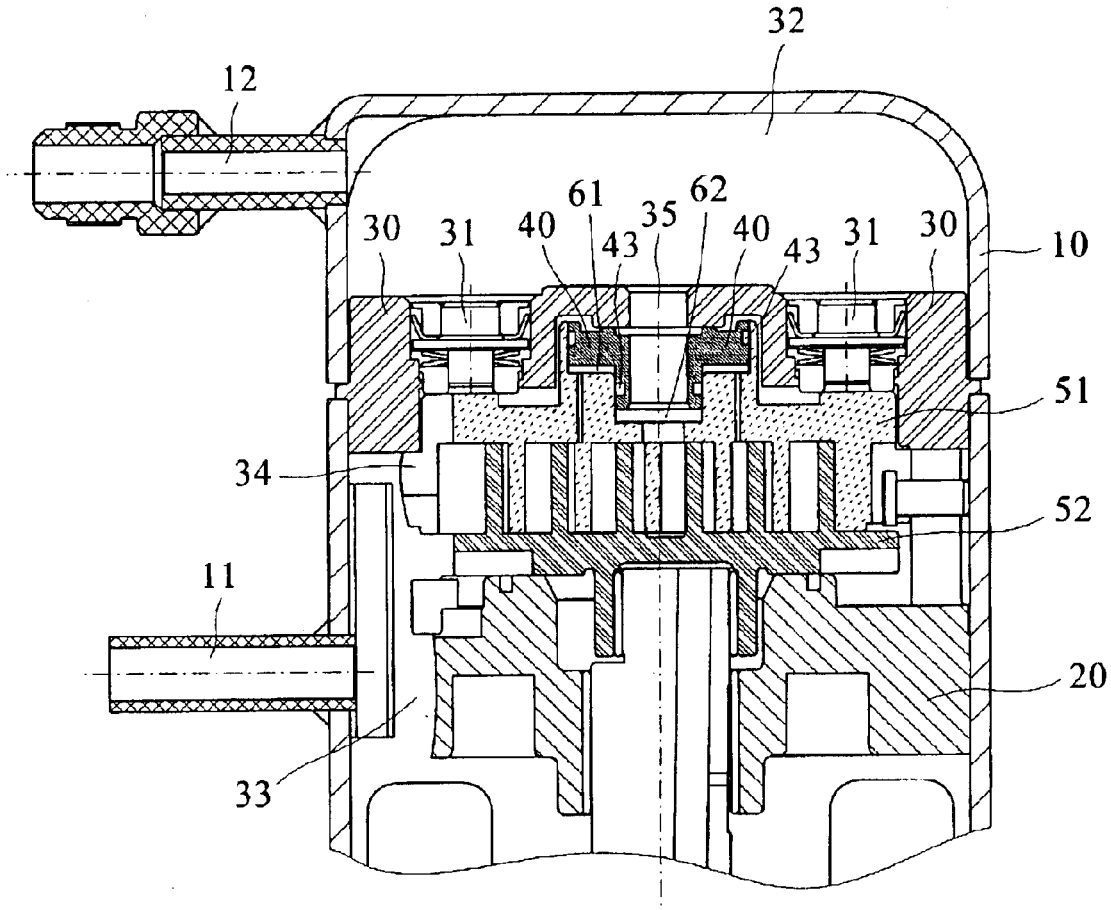
FIG. 4 illustrates a part of the vertically sectional and structural view of another embodiment of the load-regulating device for scroll type compressors of the present invention.

Please refer to FIG. 4, which shows a part of the vertically sectional and structural view of another embodiment of the load-regulating device for scroll type compressors of the present invention, wherein the partition block 30 is installed at least with a back-pressure regulating ring 31, and during the actuation of the compressor, the fluid of high pressure or medium pressure is guided into the air chamber behind the back-pressure regulating ring 31, thus forcing the back-pressure regulating ring 31 to cause the pair of scrolls to form tight contact in the direction of the axis, so as to prevent the pressurized working fluid in every compression chamber from leaking.

Figure 5:
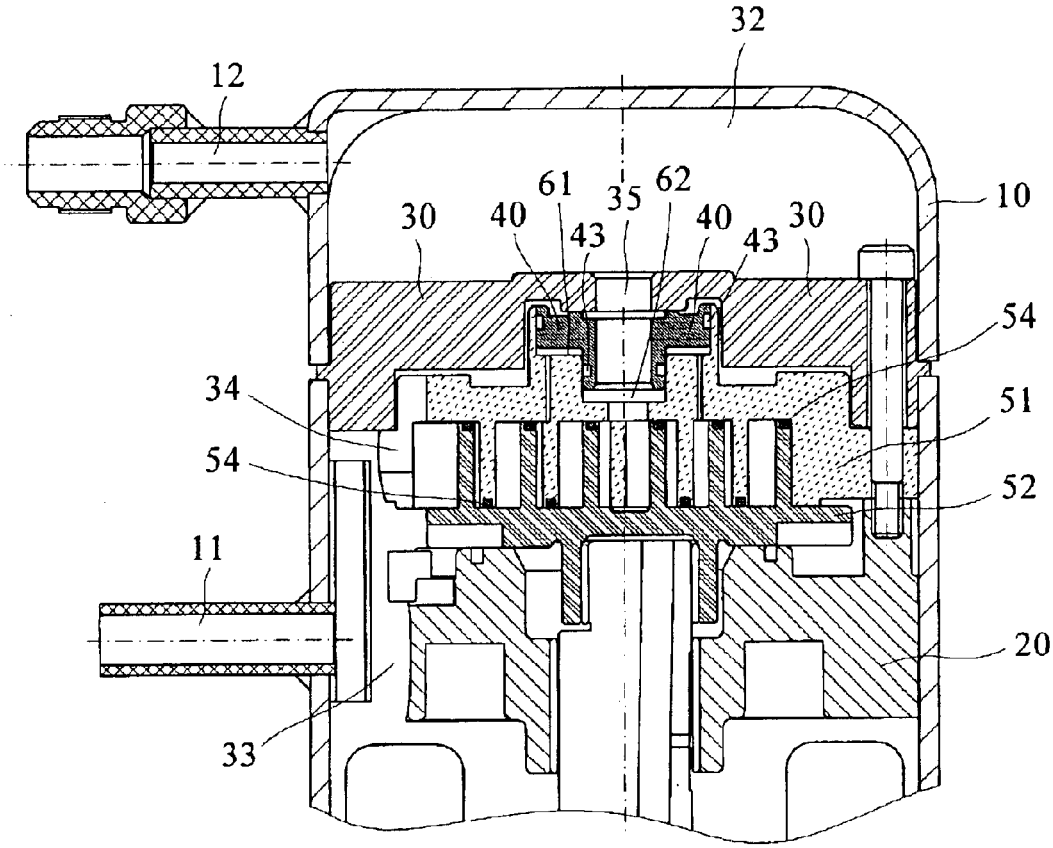
FIG. 5 illustrates a part of the vertically sectional and structural view of a further embodiment of the load-regulating device for scroll type compressors of the present invention.

Please refer to FIG. 5, which shows a part of the vertically sectional and structural view of a further embodiment of the load-regulating device for scroll type compressors of the present invention, wherein the pair of scrolls have a sealing component respectively mounted on the top of the scroll blades of both the fixed scroll 51 and the rotary scroll 52 respectively, ensuring tight contact between the fixed scroll 51 and the rotary scroll 52 during the mutual co-orbiting motion, while preventing the pressurized fluid from leaking, thus achieving the effect of the compression of the fluid.

In conclusion, the present invention utilizes the pressure variation in air chambers to cause the gliding block 40 to motion, thus as the compressor actuates, the gliding block 40 is caused to motion upwardly due to pressure variation, so as to prevent fluid in the high-pressure chamber 32 from entering the low-pressure chamber 33, and so as to cause the compressor to build pressure swiftly; as the compression ratio of the compressor becomes too great, the gliding block 40 is caused to motion downwardly due to pressure variation, so as to release a portion of the load carried, a design that meets the criteria for New Utility Model patents.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A load-regulating device for scroll type compressors, comprising:

a compressor housing having an inlet and an outlet;

a bracket body fixed inside said compressor housing with a chamber being formed between said bracket body and said compressor housing;

a partition block fixed inside said compressor housing and located on top of said bracket body to divide said chamber into a high-pressure chamber and a low-pressure chamber defined with said bracket body and said partition block, a letting-out hole being disposed at a center portion of said partition block;

a pair of scrolls, comprising a fixed scroll and a rotary scroll convoluting each other, and being installed between said partition block and said bracket body;

a round-shaped gliding block installed on a center top area of said fixed scroll directly between said letting-out hole and said fixed scroll; and a plurality of air chambers defined between said round-shaped gliding block and said pair of scrolls, wherein a pressure variation in said plurality of air chambers is used to move said round-shaped gliding block upward or downward therein;

wherein a round-shaped receiving chamber is mounted on top of said fixed scroll for receiving said round-shaped gliding block therein, and said round-shaped receiving chamber has a first chamber and a second chamber, and said first chamber is mounted on top of said second chamber, with a diameter of said first chamber being larger than a diameter of said second chamber.

2. The load-regulating device for scroll type compressors as claimed in claim 1, wherein said round-shaped gliding block includes a first portion and a second portion, and said first portion is mounted on top of said second portion, with a diameter of said first portion larger than a diameter of said second portion.

3. The load-regulating device for scroll type compressors as claimed in claim 2, wherein an air-proof member is respectively mounted on walls of said first portion and said second portion of said round-shaped gliding block.

4. The load-regulating device for scroll type compressors as claimed in claim 3, wherein said air-proof member is an O-shaped ring.

5. The load-regulating device for scroll type compressors as claimed in claim 3, said air-proof member is a polytetrafluoroethiene lip seal.

6. A load-regulating device for scroll type compressor, comprising:

a compressor housing having an inlet and an outlet;

a bracket body fixed inside said compressor housing with a chamber being formed between said bracket body and said compressor housing;

a partition block fixed inside said compressor housing and located on top of said bracket body to divide said chamber into a high-pressure chamber and a low-pressure chamber defined with said bracket body and said partition block, a letting-out hole being disposed at a center portion of said partition block;

a pair of scrolls, comprising a fixed scroll and a rotary scroll convoluting each other, and being installed between said partition block and said bracket body;

a gliding block installed on a center top area of said fixed scroll; and a plurality of air chambers defined between said gliding block and said pair of scrolls, wherein a pressure variation in said plurality of air chamber is used to move said gliding block upward or downward therein, wherein a round-shaped receiving chamber is mounted on top of said fixed scroll for receiving said round-shaped gliding block therein, and wherein said gliding block includes a first portion and a second portion, and said first portion is mounted on top of said second portion, with a diameter of said first portion longer than a diameter of said second portion.

7. The load-regulating device for scroll type compressors as claimed in claim 6, wherein said partition block further includes a back-pressure regulating ring installed thereon.

8. The load-regulating device for scroll type compressors as claimed in claim 6, wherein a top region of scroll blades of said fixed scroll and the rotary scroll includes a sealing component installed thereon.

9. The load-regulating device for scroll type compressors as claimed in claim 6, wherein said round-shaped receiving chamber has a first chamber and a second chamber, said first chamber is mounted on top of said second chamber, with a diameter of said first chamber being larger than a diameter of said second chamber.

10. The load-regulating device for scroll type compressors as claimed in claim 6, wherein an air-proof member is respectively mounted on walls of said first portion and said second portion of said gliding block.

11. The toad-regulating device for scroll type compressors as claimed in claim 10, wherein said air-proof member is an O-shaped ring.

12. The load-regulating device for scroll type compressors as claimed in claim 10, wherein said air-proof member is a polytetrafluoroethiene lip seal.

13. The load-regulating device for scroll type compressors as claimed in claim 6, wherein an air hole is defined at a center portion of said gliding block to communicate with said letting-out hole.

* * * * *